United States Patent [19]

Jeantin

[11] Patent Number: 4,781,355

[45] Date of Patent: Nov. 1, 1988

[54] HOLDER FOR MANIPULATING FLAT OBJECTS

[75] Inventor: Philippe Jeantin, Valence, France

[73] Assignee: Companie Generale D'Automatisme CGA-HBS, Paris, France

[21] Appl. No.: 79,070

[22] Filed: Jul. 29, 1987

[30] Foreign Application Priority Data

Jul. 29, 1986 [FR] France ..... 86 10971

[51] Int. Cl.[4] ..... A47B 19/00

[52] U.S. Cl. ..... 248/441.1; 248/174; 248/176; 248/206.5; 248/447

[58] Field of Search ..... 248/441.1, 447, 457, 248/371, 174, 176, 206.5, 284, 291, 558; 211/79, 80; 206/449

[56] References Cited

U.S. PATENT DOCUMENTS

| | | | |
|---|---|---|---|
| Re. 28,927 | 8/1976 | Karper . | |
| 1,253,568 | 1/1918 | Bartlett | 248/447 |
| 1,266,444 | 5/1918 | Fosberg et al. | 248/447 |
| 2,612,721 | 10/1952 | Pollard . | |
| 3,003,626 | 10/1961 | Richards et al. . | |
| 4,300,743 | 11/1981 | Morris | 248/441.1 |
| 4,422,613 | 12/1983 | Cray et al. | 248/441.1 X |
| 4,456,128 | 6/1984 | Warshaw . | |

*Primary Examiner*—Ramon O. Ramirez
*Attorney, Agent, or Firm*—Sughrue, Mion, Zinn, Macpeak & Seas

[57] ABSTRACT

A holder for selectively manipulating small format flat objects and large format flat objects comprises a support assembly adapted to pivot between two stable positions. This assembly is formed by first and second members attached perpendicularly to respective opposite sides of a third member. The first and third members form an L-shaped support for large format objects in one of the two stable positions. The second and third members form a T-shaped assembly. A base has an inclined end portion on which the support assembly is pivotally mounted at a point between the second member and the point at which the first member and the second member are attached together. As a result, the support assembly pivots about an axis which is substantially coincident with the intersection of the second and third members. A first of the two stable positions is defined by an abutting relationship between the inclined end portion of the base and the second member. In this position the L-shaped support is at the end of the base, facing the user. The second of the two stable positions is defined by an abutting relationship between the inclined end portion of the base and the part of the second member to which the first member is attached. In this position the half of the T-shaped assembly to which the first member is not attached is at the end of the base, facing the user and forming a support for the small format objects. Selectively operable first and second locking devices lock the support assembly into the two stable positions. They comprise magnets adapted to hold the second member and the third member against the end portion of the base.

6 Claims, 2 Drawing Sheets

HOLDER FOR MANIPULATING FLAT OBJECTS

BACKGROUND OF THE INVENTION

1. Field of the Invention

The present invention concerns the manipulation of flat objects that have to be individually processed or checked.

These flat objects may be mail packets, for example. They have to be marked with a code indicating the complete address or part of the address that they carry, their destination in particular, so that they can subsequently be sorted automatically.

2. Description of the prior art

At manual coding stations the mail packets arrive stacked in baskets. An operator at each coding station takes the mail packets one by one from the basket, notes the information to be coded and enters this on a keyboard and then places the mail packets in a second basket in the order in which they are taken up. A processing circuit link between the keyboard and a label printing circuit makes it possible to print the marking codes onto a strip of labels with or without the complete address or to print a new address and its marking code in the case of a re-addressing operation.

Another operator takes the printed labels one by one and sticks them onto the mail packets stacked in their original order in the second basket. These mail packets can then be sorted automatically by a sorting machine.

The mail packets supplied to the operator at each manual coding station are generally pre-sorted according to their size.

Mail packets such as postcards, small and medium-size envelopes and the like, on the one hand, and mail packets such as larger envelopes and magazines, on the other hand, arrive stacked in separate baskets assigned to each of the two categories of mail packets. After input of information these mail packets are in a similar manner placed in separate second baskets assigned to the two categories of mail packets.

An object of the present invention is to assist the operator at this type of station in manipulating mail packets of other objects, to facilitate such manipulation and to enable it to be conducted at significantly higher speed.

SUMMARY OF THE INVENTION

The present invention consists in a holder for selectively manipulating flat objects having one of two formate referred to hereinafter as small format objects and large format objects, said holder comprising a support assembly adapted to pivot between two stable positions and formed by first and second members attached perpendicularly to respective opposite sides of a third member, said first and third members forming an L-shaped support for said large format objects in one of said two stable positions and said second and third members forming a T-shaped assembly, and a base which incoporates an inclined end portion on which said support assembly is pivotally mounted at a point between said second member and the point at which said first member and said second member are attached together, whereby said support assembly pivots about an axis substantially coincident with the intersection of said second and third members, the arrangement being such that a first of said two stable positions is defined by an abutting relationship between said inclined end portion of said base and said second member with said L-shaped support at the end of said base and facing the user and a second of said two stable positions is defined by an abutting relationship between said inclined end portion of said base and the part of said second member to which said first member is attached with the half of said T-shaped assembly to which said first member is not attached at the end of said base, facing the user and forming a support for said small format objects.

Magnets advantageously lock said assembly into one or other of said stable positions.

The characteristics and advantages of the present invention will emerge from the following description of one embodiment thereof given with reference to the appended drawings.

DESCRIPTION OF THE PREFERRED EMBODIMENT

Figure 1:
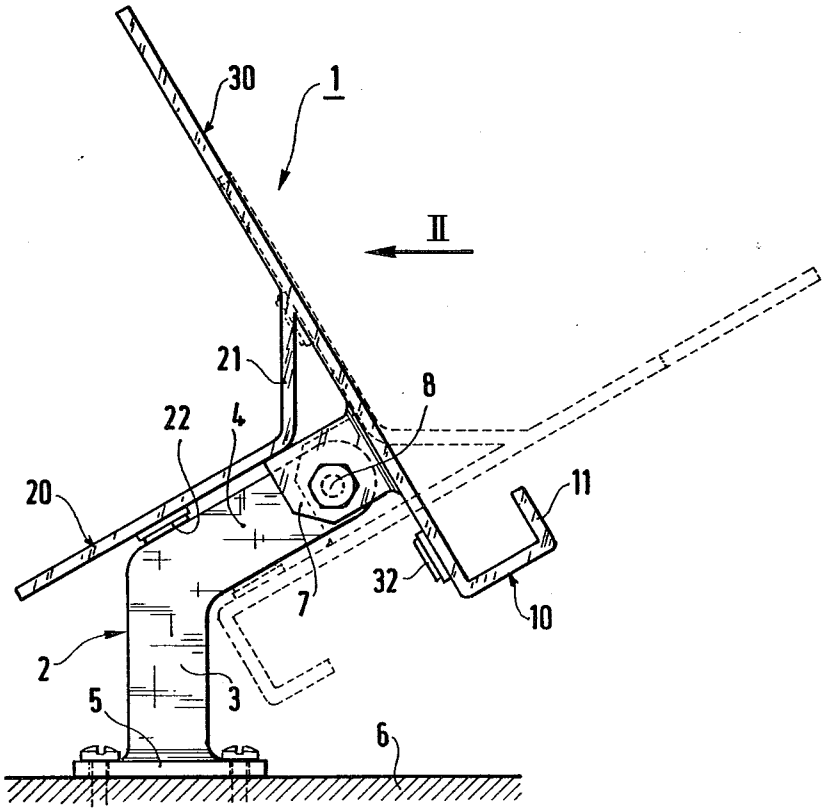
FIG. 1 is side view of the holder in accordance with the invention for manipulating flat objects.

FIG. 1 shows that the holder in accordance with the invention for manipulating flat objects is formed by a support assembly 1 mounted on a base 2 having a vertical part 3 and an inclined end portion 4. A baseplate 5 attaches the holder to a table 6. This baseplate is shown screwed to the table but could instead be large enough and heavy enough to support the holder in a stable way without being fixed to the table.

The support assembly 1 comprises three members 10, 20 and 30.

The first and second of these members, 10 and 20, are parallel; they lie one on each side of the third member 30, relative to which they are generally transversely disposed. The first member 10 is on the front of and at the edge of the third member, defining with it an L-shaped profile. The first member 10 has an upstanding edge 11 parallel to the third member 30 so as to form on the latter a sort of trough. The second member 20 extends away from substantially the middle of the other side or back of the third member, defining with it a T-shaped profile. The second member 20 defines two halves of the third member and merges with the half to which the first member 10 is not attached through an obliquely disposed portion 21. This transitional part 21 "rounds off" the intersection between the second member and this part of the third member. The third member 30, which is common to the L-shaped profile and the T-shaped profile, constitutes the transverse top of the T-shaped profile and the longer branch of the L-shaped profile.

Figure 2:
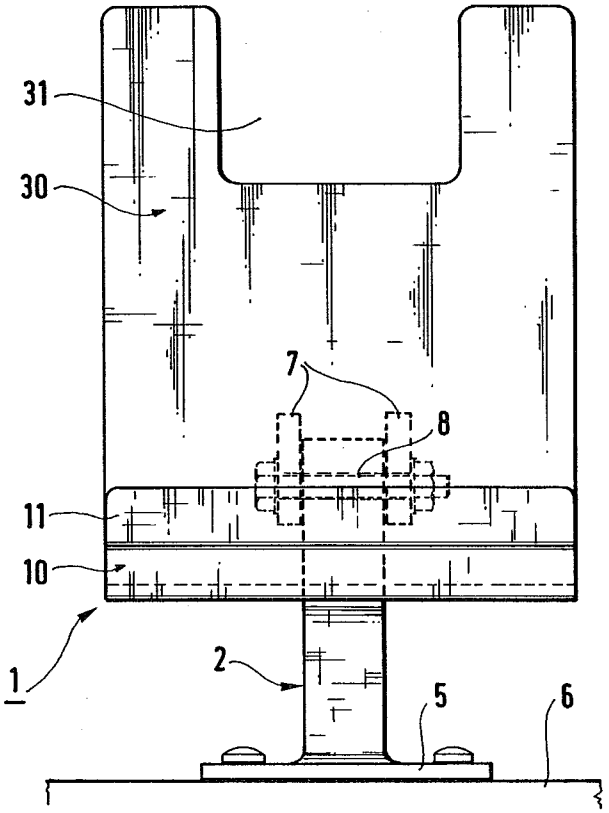
FIG. 2 shows it from the front, in the direction of the arrow II in FIG. 1.

FIG. 2 shows that this third member has a notch 31 opening into its edge opposite that carrying the first member and extending towards its central part.

As shown in full line in FIG. 1 the first and third members 10 and 30 of the support assembly 1 constitute a first support for relatively large flat objects referred to herein as large format objects. As shown in dashed outline in FIG. 1, its second member 20 and the part of its third member 30 which does not carry the first member 10 constitute a second support for relatively small flat objects referred to herein as small format objects. The support assembly 1 is pivoted to the end of the inclined end portion 4 of the base 2 to offer up to the operator at the front end of the base either the first support or the second support just mentioned.

In FIGS. 1 and 2 it can be seen that the support assembly 1 comprises two lugs 7 formed on the back of the third member, between the second member and the part of the third member to one side of the second member carrying the first member. The distance between these two lugs corresponds to the thickness of the end portion 4 of the base onto which they are fitted forkwise.

A bolt 8 inserted through appropriate holes in the lugs 7 and the end portion 4 of the base serves to pivot the support assembly 1 to the end of the base.

This pivoting attachment by the bolt makes it possible to place the support assembly 1 in a first stable limiting position in which the first support for the large format objects formed by the members 10 and 30 is at the end of the base, the member 20 being then set back along the end part 4 of the base and in an abutting relationship with it. It also makes it possible to place the support assembly 1 in a second stable limiting position in which the second support for the small format objects formed by the member 20 and part of the member 30 is at the end of the base, the other part of the member 30 together with the member 10 that it carries being then set back along the end portion of the base and in abutting relationship with it.

The support assembly is preferably made from plastics material. The members are bonded together or the support assembly as a whole is molded in one piece. The base may be of metal or plastics material.

Magnets 22 and 32 are attached to the holder to lock selectively the support assembly 1 into one or other of its two stable limiting positions, as required. The magnet 22 is stuck onto the side of the second member 20 which bears against the end portion of the base, which is assumed to be of metal in this case. The magnet 32 is attached to the back of the part of the third member 30 carrying the first member and coming into an abutting relationship against the end portion of the base. The support assembly is moved from one of its stable positions to the other by rotating it, the initial unlocking being achieved by exerting sufficient force to overcome the force of the magnet concerned.

It is to be understood that other arrangements within the competence of those skilled in the art may be employed for the aforementioned magnets, in particular according to the materials from which the support assembly and the base are made. For example, the magnets could be fixed directly or through the intermediary of lugs onto the end portion of the base, whether the latter is or metal or plastics material, with corresponding metal parts attached to the members 20 and 30 of the support assembly, with these made from a plastics material.

Figure 3:
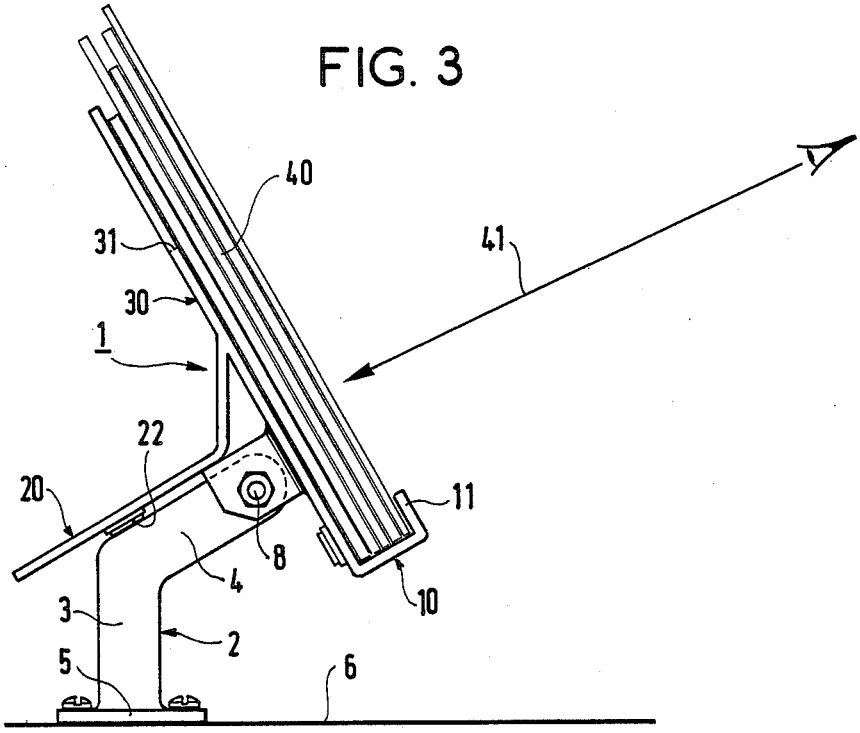
FIGS. 3 and 4 are two side view of the holder showing the two stable positions.
Figure 4:
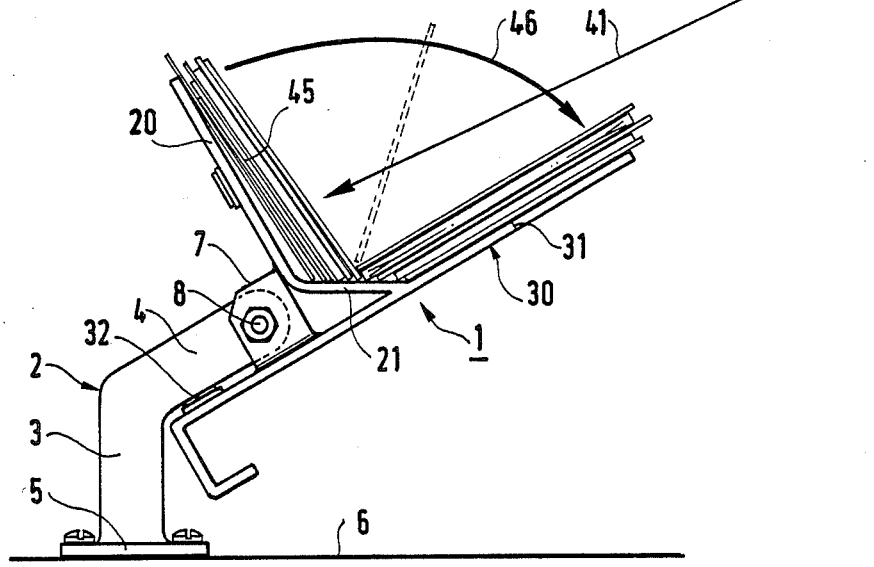

FIGS. 3 and 4 show the same holder on the table in its two stable positions in which it is used to manipulate mail packets of a first format category referred to herein as large format mail packets, such as magazines, large envelopes and the like, and for manipulating mail packets of a second format category referred to herein as small format mail packets, such as ordinary size letters, postcards and the like, at a station for manually coding mail packets.

In FIG. 3 a small wad of large format mail packets 40 has been loaded by the operator and is held by the support formed by the members 10 and 30; the support 10, 30 is at the end of the base and inclined before the operator. The operator enters the information to be coded from the addresses carried by the mail packets facing towards him. The arrow 41 schematically represents the visual acquisition of this information. After the information is got from the front mail packet, the operator uses his keyboard to enter this information into an appropriate processing circuit for printing a label, this latter operation using the keyboard not being represented. The operator then takes off the front mail packet and puts the mail packets away one by one in order. These mail packets receive their printed label at an adjacent workstation.

In FIG. 4 a handful of small format mail packets 45, the number of which can be much greater than the number of large format mail packets on their support, has been loaded onto and is retained on their own support 20/30, which is at the end of the base and inclined facing the operator. The oblique transitional part 21 provides a substantially horizontal seating for this handful of mail packets, which rest on it edgewise. The operator enters the information from the front mail packet for coding and printing each label, as previously; once again this operation is schematically represented by an arrow 41.

As each mail packet is processed, the operator can advantageously tilt the front mail packet forward, as shown by the arrow 46, to expose the next mail packet. He proceeds in this way to process all of the mail packets in the handful loaded onto the support and then removes the handful of mail packets from the support. The notch 31 in the end of the third member 30 on which the handful of mail packets rests flat after tilting makes it easy to grasp the handful of mail packets to take them off and put them away.

The present invention has been described with reference to the embodiment shown but it is to be understood that modifications of detail may be applied to it without departing from the scope of the invention.

I claim:

1. Holder for selectively manipulating flat objects having one of two formats referred to hereinafter as small format objects and large format objects, said holder comprising a support assembly adapted to pivot between two stable positions and formed by first and second members attached perpendicularly to respective opposite sides of a third member, said first and third members forming an L-shaped support for said large format objects in one of said two stable positions and said second and third members forming a T-shaped assembly, and a base which incoporates an inclined end portion on which said support assembly is pivotally mounted at a point between said second member and the point at which said first member and said second member are attached together, whereby said support assembly pivots about an axis substantially coincident with the intersection of said second and third members, the arrangement being such that a first of said two stable positions is defined by an abutting relationship between said inclined end portion of said base and said second member with said L-shaped support at the end of said base and facing the user and a second of said two stable positions is defined by an abutting relationship between said inclined end portion of said base and the part of said second member to which said first member is attached with the half of said T-shaped assembly to which said first member is not attached at the end of said base, facing the user and forming a support for said small format objects.

2. Holder according to claim 1, further comprising selectively operable first and second locking devices for locking said support assembly in said two stable positions.

3. Holder according to claim 2, wherein said first and second locking devices comprise magnets adapted to hold said second member and said third member against said end portion of said base.

4. Holder according to claim 1, wherein said third member has a notch in the end opposite that attached to said first member.

5. Holder according to claim 1, wherein said second member has an obliquely disposed part through which it is attached to said third member.

6. Holder according to claim 1, wherein said first member has an upstanding edge parallel to said third member and defining therewith a trough.

* * * * *